US007728265B1

(12) United States Patent
Deeds et al.

(10) Patent No.: US 7,728,265 B1
(45) Date of Patent: Jun. 1, 2010

(54) MEMS TYPE FLOW ACTUATED OUT-OF-PLANE FLAP

(75) Inventors: Michael A. Deeds, Port Tobacco, MD (US); David Herman, Charlotte, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 319 days.

(21) Appl. No.: 11/729,088

(22) Filed: Mar. 26, 2007

(51) Int. Cl.
*F41G 7/00* (2006.01)
*F42B 12/20* (2006.01)

(52) U.S. Cl. ..... 244/3.21; 244/3.29; 244/198; 244/199.3; 244/213; 102/501; 102/490

(58) Field of Classification Search ..... 244/3.21, 244/3.24, 3.28, 3.29, 198, 199.3, 213
See application file for complete search history.

(56) References Cited

U.S. PATENT DOCUMENTS 5,425,223 A * 6/1995 DeLaRonde ..... 56/10.2 R
5,824,910 A 10/1998 Last et al.
5,913,642 A * 6/1999 Boehler et al. ..... 406/171
6,069,392 A 5/2000 Tai et al.
6,105,904 A 8/2000 Lisy et al.
6,175,170 B1 1/2001 Kota et al.
6,210,046 B1 4/2001 Rogers et al.
6,474,593 B1 11/2002 Lipeles et al.
6,685,143 B1 2/2004 Prince et al.
6,804,036 B1 10/2004 Chen et al.
6,853,765 B1 2/2005 Cochran
2003/0218102 A1 11/2003 Van Dam et al.

OTHER PUBLICATIONS

U.S. Appl. No. 11/729,089, filed Mar. 26, 2007, Deeds et al.
U.S. Appl. No. 11/729,086, filed Mar. 26, 2007, Linn et al.

* cited by examiner

*Primary Examiner*—J. Woodrow Eldred
(74) *Attorney, Agent, or Firm*—Fredric J. Zimmerman

(57) ABSTRACT

A MEMS type flow actuated out-of-plane flap apparatus includes a substrate defining a plane; a duct attached to the substrate, the duct and the substrate defining a fluid flow channel; and a rotatable flap having a flow receiving portion and an extension portion. The flow receiving portion being disposed in the fluid flow channel where, in an actuated position of the flap, a fluid flow against the flow receiving portion causes rotation of the flap and movement of the extension portion out of the plane of the substrate.

6 Claims, 3 Drawing Sheets

MEMS TYPE FLOW ACTUATED OUT-OF-PLANE FLAP

STATEMENT OF GOVERNMENT INTEREST

The invention described herein may be manufactured and used by or for the government of the United States of America for government purposes without the payment of any royalties thereof.

BACKGROUND OF THE INVENTION

The invention relates in general to microelectromechanical (MEMS) devices and in particular to MEMS devices that provide deflection out of the plane of the MEMS substrate.

Conventional systems for guiding missiles or projectiles in flight use canards, or small wing-like structures, to steer the projectile. These structures are large (approximately 3" in length) and require motors to actuate. The stabilizing fins on the projectile have to be increased in size to counteract the effect the canards have of moving the center of pressure forward.

A MEMS control surface can reduce drag and hence increase the range of projectiles by eliminating the drag associated with canards and reducing the drag of the fins. In addition, MEMS control surfaces may reduce volume, weight, and power requirements, further increasing the projectile's range. Another added benefit of the MEMS control surface is the reduction of cost associated with batch fabrication techniques.

Known MEMS devices for producing a mechanical deflection include various types of thermally actuated beams, including cantilever and arch beams. These beams have proven successful in producing a deflection in the plane of the MEMS substrate. Devices such as projectile control surfaces, however, require a deflection out of the plane of the MEMS substrate, that is, in a direction perpendicular to the MEMS substrate.

One MEMS type apparatus that provides out-of-plane deflection is shown in U.S. Pat. No. 5,824,910 issued on Oct. 20, 1998 and entitled "Miniature Hydrostat Fabricated Using Multiple Microelectromechanical Processes." Another MEMS type apparatus that provides out-of-plane deflection is shown in U.S. Pat. No. 6,069,392 issued on May 30, 2000 and entitled "Microbellows Actuator." These two U.S. patents are expressly incorporated by reference. A third MEMS type apparatus that provides out-of-plane deflection is shown in U.S. Pat. No. 6,474,593 issued on Nov. 5, 2002 and entitled "Guided Bullet."

SUMMARY OF THE INVENTION

It is an aspect of the invention to provide a MEMS device that can provide vertical deflection out of the plane of the MEMS substrate.

It is another aspect of the invention to provide a MEMS device that is operable as a control surface for high-speed projectiles.

Yet another aspect of the invention is to provide a MEMS device that provides out-of-plane deflection with a minimum of moving parts.

One aspect of the invention is a MEMS apparatus including a substrate defining a plane; a duct attached to the substrate, the duct and the substrate defining a fluid flow channel; and a rotatable flap having a flow receiving portion and an extension portion, the flow receiving portion being disposed in the fluid flow channel where in an actuated position of the flap a fluid flow against the flow receiving portion causes rotation of the flap and movement of the extension portion out of the plane of the substrate. In a rest position of the flap the extension portion is substantially parallel to the plane of the substrate.

The MEMS apparatus may further include a flap support for rotatably supporting the flap. The flap support may include a pair of supports disposed on the substrate on opposite sides of the flap, the flap being rotatably connected to the pair of supports.

In one embodiment, the MEMS apparatus includes openings in each of the pair of supports, a through hole in the flap and an axle disposed in the through hole and the openings in the supports, the axle being free to rotate with respect to the flap and the supports.

In a second embodiment, the MEMS apparatus includes openings in each of the pair of supports and an axle fixed to the flap, the axle being disposed in the openings in the supports and free to rotate with respect to the supports.

In a third embodiment, the MEMS apparatus includes a through hole in the flap and an axle fixed to the pair of supports, the axle being disposed in the through hole in the flap and free to rotate with respect to the flap.

In a fourth embodiment, the MEMS apparatus includes a pair of torsion springs fixed at first ends to the flap and at second ends to the pair of supports, respectively, the pair of torsion springs being operable to twist as the flap rotates.

Another aspect of the invention is a projectile comprising a flow surface; at least one MEMS apparatus as described above disposed at the flow surface such that, in a rest position of the flap, the MEMS apparatus is substantially flush with the flow surface and in the actuated position of the flap, the extension portion of the flap extends out of a plane of the flow surface.

BRIEF DESCRIPTION OF THE DRAWINGS

In the drawings, which are not necessarily to scale, like or corresponding parts are denoted by like or corresponding reference numerals.

DETAILED DESCRIPTION OF EXEMPLARY EMBODIMENTS OF THE INVENTION

Figure 1A:
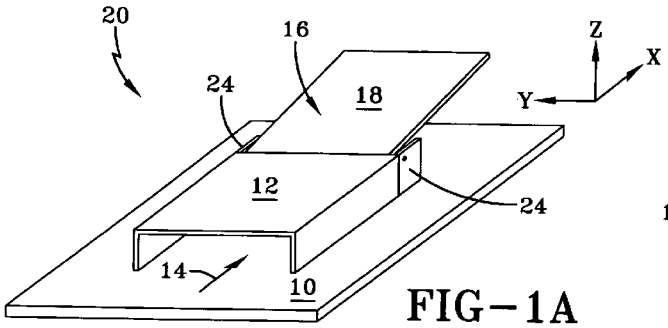
FIG. 1A is a schematic perspective view of an embodiment of the invention.
Figure 1B:
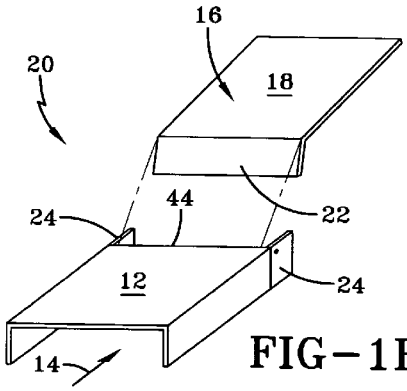
FIG. 1B is an exploded view of FIG. 1A.

FIG. 1A is a schematic perspective view of an embodiment of a MEMS type flow actuated out-of-plane flap apparatus 20 in accordance with the invention. FIG. 1B is an exploded view of FIG. 1A. The MEMS apparatus 20 includes a substrate 10 defining an XY plane and a duct 12 attached to the substrate 10. The duct 12 and the substrate 10 define a fluid flow channel 14. A rotatable flap 16 has a flow receiving portion 22 and an extension portion 18. The flow receiving portion 22 is disposed in the fluid flow channel 14. A flap support 24 rotatably supports the flap 16. The flap support 24 may be integral with or separate from duct 12.

Figure 2A:
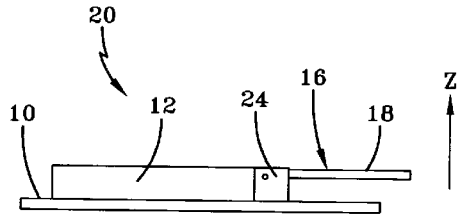
FIG. 2A is a side view of FIG. 1A with the flap in the rest position.
Figure 2B:
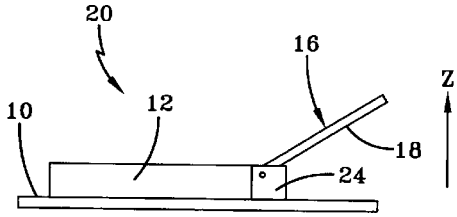
FIG. 2B is a side view with the flap in the actuated position.

FIG. 2A is a side view of FIG. 1A with the flap 16 in the rest position. FIG. 2B is a side view with the flap 16 in the actuated position. In the actuated position of the flap 16, the fluid flow 14 against the flow receiving portion 22 causes rotation of the flap 16 and movement of the extension portion 18 out of the XY plane of the substrate 10. In the rest position of the flap 16 (FIG. 2A), the extension portion 18 is substantially parallel to the plane of the substrate 10.

Figure 3:
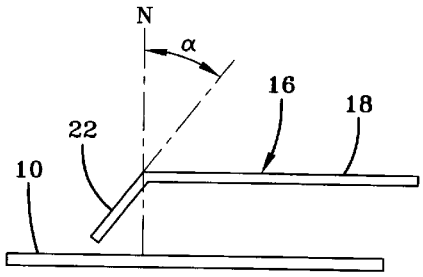
FIG. 3 is a side view of a flap.

FIG. 3 schematically shows a flap 16 in the rest position. For clarity, the support 24 and duct 12 are not shown. The angle alpha ($\alpha$) is the angle between a line N normal to the substrate 10 and the flow receiving portion 22. The angle alpha may be varied depending upon the desired amount of deflection of flap 16. For example, if one wants flap 16 to deflect about 45 degrees, then, in an exemplary embodiment, alpha is about 22.5 degrees. If one wants flap 16 to deflect about 30 degrees, then, in an exemplary embodiment, alpha is about 15 degrees.

Figure 4:
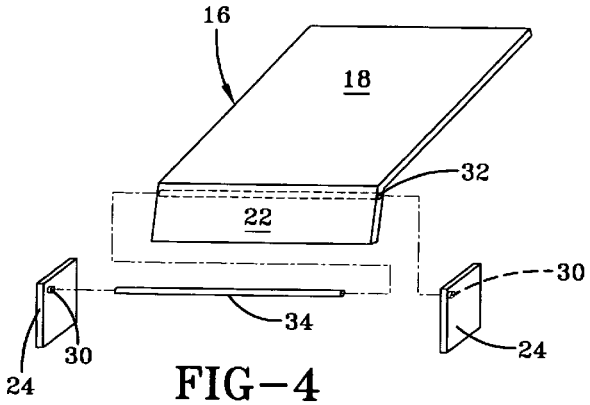
FIG. 4 is an exploded view of a rotatable flap support.

The rotatable support for flap 16 may be realized in many ways. For example, the flap support may comprise a pair of supports 24 (FIGS. 1A and B) disposed on the substrate 10 on opposite sides of the flap 16 where the flap 16 is rotatably connected to the pair of supports 24. FIG. 4 shows a pair of supports 24 having openings 30 formed therein. The flow receiving portion 22 of flap 16 includes a through hole 32. An axle 34 is disposed in the through hole 32 and the openings 30 in the supports 24 where the axle 34 is free to rotate with respect to the flap 16 and the supports 24.

In another embodiment, the axle 34 may be fixed to the flap 16 and free to rotate with respect to the supports 24. In a further exemplary embodiment, the axle 34 may be fixed to the supports 24 and free to rotate with respect to the flap 16. In yet another embodiment, the axle 34 may be fixed to both the flap 16 and the supports 24 where the axle includes a torsion spring or pair of torsion springs that are operable to twist as the flap 16 rotates. It is important to locate the axis of rotation (the centerline of the axle) vertically above (the Z direction) the horizontal centerline of the flow receiving portion 22. In this way, the moment created by the fluid force on the flow receiving portion 22 will tend to rotate the flap 16 up and away from the substrate 10.

Figure 5:
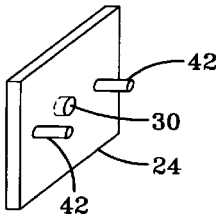
FIG. 5 shows part of a flap support.

The rest position (FIG. 2A) of the flap 16 may be maintained in a variety of ways. For example, the apparatus 20 may be sized so that during downward rotation of the flap 16, when the extension portion 18 butts against the front surface 44 (FIG. 1B) of the duct 12, the extension portion 18 is substantially horizontal in relation to the X-axis, and thus the extension portion 18 is substantially parallel to the substrate 10. Another exemplary method is to use pins or tabs attached to the inside of the supports 24, as shown in FIG. 5. FIG. 5 shows one support 24 having stop pins 42 formed thereon. The stop pins 42 may be located on the supports 24 to control maximum rotation of the flap 16 in both the up and down directions. When the flap 16 reaches a maximum rotation, the flow receiving portion 22 of the flap 16 will butt against a stop pin 42.

Figure 6:
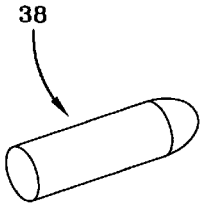
FIG. 6 shows a projectile.
Figure 7:
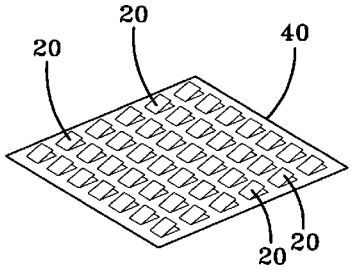
FIG. 7 shows a flow surface.

In an exemplary embodiment, the MEMS apparatus 20 may also be used to steer a projectile. FIG. 6 shows a projectile 38. As used herein, a projectile 38 may be a missile, rocket or any type of projectile, with or without fins, that is launched in air or water. FIG. 7 shows a portion of a flow surface 40 of a projectile 38. The flow surface 40 may be the external surface of the projectile 38 or it may be the surface of a fin, wing, rudder, etc. A plurality of MEMS apparatus 20 are disposed in an array on the flow surface 40. The MEMS apparatus 20 may be arrayed in any manner and number required to steer the projectile 38. When the extension portions 18 of the flaps 16 are extended upward into the flow stream around surface 40, the flaps will influence the flow stream and alter the path of the projectile 38. A number of the apparatus 20 may be placed in series such that the flow entering at one end is used to actuate the entire series of flaps.

Figure 8:
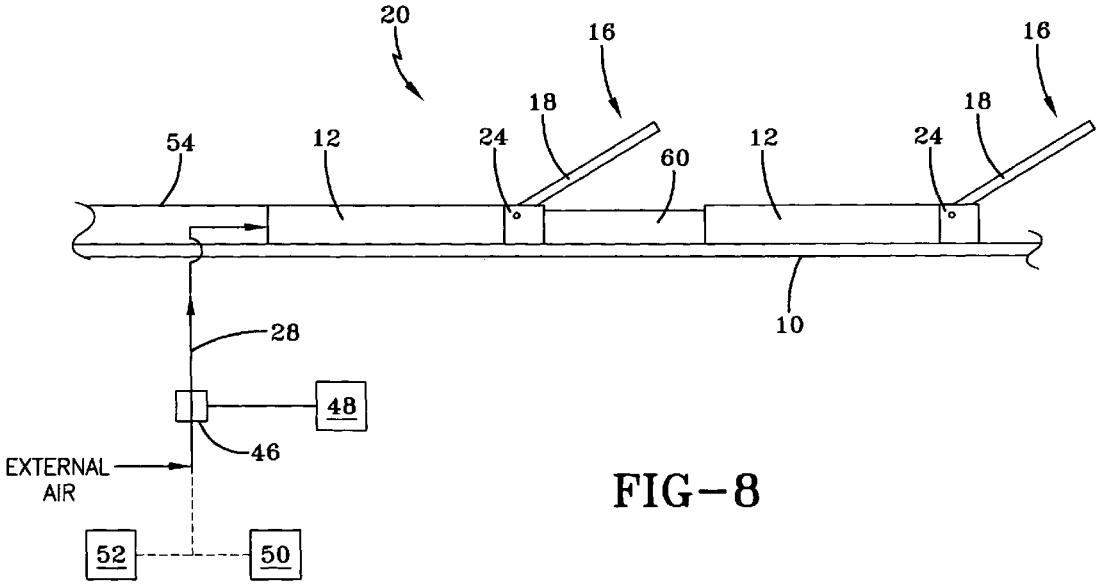
FIG. 8 shows the MEMS apparatus embodied in a projectile.

FIG. 8 is a schematic side view of the MEMS apparatus 20 incorporated in a flow surface 54 and in an actuated position. The MEMS apparatus 20 is disposed at the flow surface 54 such that in the off position the flap 16 is substantially flush with the flow surface 54. In the actuated position (FIG. 8), the flap 16 extends out of the plane of the flow surface 54. Fluid that passes under the flap 16 is directed thru duct portion 60 to the next duct 12. Duct portion 60 may be shorter than duct 12, thereby providing a rest position for the flap 16. A source of fluid pressure enters duct 12 through a fluid connection 28. A control valve 46 is disposed in the fluid connection 28. The control valve 46 is connected to and operable by a guidance and control system 48.

The source of fluid pressure may be external air, combustion products from a combustion chamber 50, and/or an onboard stored energy source 52, such as a pressure tank or a compressor. When using external air as a source of fluid pressure, the flap 16 will rotate until the external fluid force on the flap is the same as the internal fluid force on the flow receiving portion 22. In this instance, flap rotation may be increased by enlarging the area of the flow receiving portion 22 relative to the extension portion 18

While the invention has been described with reference to certain exemplary embodiments, numerous changes, alterations and modifications to the described embodiments are possible without departing from the spirit and scope of the invention as defined in the appended claims, and equivalents thereof.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A projectile, comprising:

a flow surface; and a plurality of microelectromechanical (MEMS) apparatus being disposed at the flow surface, wherein each MEMS apparatus of said plurality of MEMS apparatus comprises a substrate, which defines a first plane, a duct is attached to the substrate, the duct and the substrate define a fluid flow channel, and a rotatable flap comprises a flow receiving portion and an extension portion where the flow receiving portion is disposed in the fluid flow channel, wherein, in an actuated position of the rotatable flap, a fluid flow against the flow receiving portion causes rotation of the rotatable flap and movement of the extension portion out of the first plane of the substrate, wherein, in a rest position of the rotatable flap, the MEMS apparatus is substantially flush with the flow surface, and wherein, in the actuated position of the rotatable flap, the extension portion of the rotatable flap extends out of a plane of the flow surface.

2. The projectile of claim 1, further comprising a source of fluid pressure; and a fluid connection being located between the source of fluid pressure and the duct of the MEMS apparatus.

3. The projectile of claim 2, wherein the source of fluid pressure comprises one of external air, combustion products and stored energy.

4. The projectile of claim 2, further comprising a control valve being disposed in the fluid connection.

5. The projectile of claim 2, further comprising a control valve being disposed in the fluid connection; and a guidance and control system being connected to the control valve.

6. A projectile, comprising:

a flow surface;

at least one microelectromechanical (MEMS) apparatus being disposed at the flow surface, wherein said at least one MEMS apparatus comprises a substrate, which defines a first plane, a duct is attached to the substrate, the duct and the substrate define a fluid flow channel, and a rotatable flap comprises a flow receiving portion and an extension portion where the flow receiving portion is disposed in the fluid flow channel, wherein, in a rest position of the rotatable flap, the MEMS apparatus is substantially flush with the flow surface, and wherein, in an actuated position of the rotatable flap, the extension portion of the rotatable flap extends out of a plane of the flow surface;

a source of fluid pressure and a fluid connection, said fluid connection is situated between the source of fluid pressure and the duct of the MEMS apparatus;

a control valve being disposed in the fluid connection; and a guidance and control system being connected to the control valve, wherein the source of fluid pressure comprises one of external air, combustion products and stored energy.

* * * * *